US009173441B2

(12) United States Patent
Chumbler

(10) Patent No.: US 9,173,441 B2
(45) Date of Patent: Nov. 3, 2015

(54) RACE BIB PROTECTIVE POCKET

(71) Applicant: Brian Chumbler, Tucson, AZ (US)

(72) Inventor: Brian Chumbler, Tucson, AZ (US)

(73) Assignees: Orlando Alva, Tucson, AZ (US); Brian Chumbler, Tucson, AZ (US)

( * ) Notice: Subject to any disclaimer, the term of this patent is extended or adjusted under 35 U.S.C. 154(b) by 0 days.

(21) Appl. No.: 14/090,794

(22) Filed: Nov. 26, 2013

(65) Prior Publication Data

US 2014/0283283 A1 Sep. 25, 2014

Related U.S. Application Data

(60) Provisional application No. 61/803,935, filed on Mar. 21, 2013.

(51) Int. Cl.

| | |
|---|---|
| ***A41D 27/20*** | (2006.01) |
| ***G09F 21/02*** | (2006.01) |
| ***G09F 3/20*** | (2006.01) |
| *A41D 13/00* | (2006.01) |

(52) U.S. Cl.

CPC *A41D 27/20* (2013.01); *G09F 3/20* (2013.01); *G09F 21/026* (2013.01); *A41D 13/0015* (2013.01)

(58) Field of Classification Search

CPC ..... A41D 27/08; A41D 27/20; A41D 27/201; A41D 27/205; A41D 27/204; A41D 13/0015; A41D 13/0012; G09F 21/02; G09F 3/00

USPC ..... 2/122, 253, 244, 247, 250, 252, 94; 40/586

See application file for complete search history.

(56) References Cited

U.S. PATENT DOCUMENTS

| | | | |
|---|---|---|---|
| 1,060,229 | A | 4/1913 | Casper et al. |
| 1,436,854 | A | 11/1922 | Brady |
| 2,022,793 | A | 12/1935 | Trickel |
| 2,596,884 | A | 3/1952 | Bailen |
| 2,671,902 | A | 3/1954 | Grue |
| 2,821,035 | A | 1/1958 | Joseph |
| 2,871,485 | A | 2/1959 | Greco |

(Continued)

FOREIGN PATENT DOCUMENTS

| | | | |
|---|---|---|---|
| GB | 2054349 | A | 2/1981 |
| GB | 2089644 | A | 6/1982 |

*Primary Examiner* — Andrew W Collins

(74) *Attorney, Agent, or Firm* — Greenberg Traurig, LLP

(57) ABSTRACT

A protective pocket is provided for a substantially two-dimensional object, such as a race bib. The protective pocket includes cooperating first and second lightweight fabrics, and an opening for receiving the object. The first fabric may be an item of a race participant's apparel or a backing that itself is attached to such an apparel item. The second fabric may be a mesh member having spaced apertures through which the object is visible and exposed to elements. The protective pocket is configured to maintain the object in a substantially vertical planar orientation, and thereby in an "upright" position, such that it that is (a) substantially parallel to the plane defined by the adjacent surface of the race participant's apparel item, and (b) substantially parallel to the plane defined by the adjacent body part of the race participant (e.g., a torso or leg). This positioning also improves the visibility of the indicia printed on the object through the mesh member. In order to facilitate this positioning, the mesh member is tightly secured to the first fabric so as to allow limited movement between open and closed positions.

13 Claims, 3 Drawing Sheets

(56) References Cited

U.S. PATENT DOCUMENTS

| | | | | | |
|---|---|---|---|---|---|
| 2,986,743 | A | | 6/1961 | Eilen | |
| 3,051,962 | A | | 9/1962 | Lippman | |
| 3,370,370 | A | | 2/1968 | Lippman | |
| 3,371,829 | A | | 3/1968 | Phillips | |
| 3,582,993 | A | | 6/1971 | Keller | |
| 3,647,056 | A | | 3/1972 | Jacobson et al. | |
| 3,744,059 | A | | 7/1973 | Hayes | |
| 3,797,717 | A | | 3/1974 | Collins | |
| 4,259,797 | A | | 4/1981 | Belser | |
| 4,389,801 | A | | 6/1983 | Sharrock | |
| 4,549,916 | A | * | 10/1985 | Off et al. | 156/93 |
| 4,602,390 | A | | 7/1986 | Morera et al. | |
| 4,625,337 | A | | 12/1986 | Zahn | |
| 4,650,219 | A | | 3/1987 | Sigman | |
| 4,698,848 | A | | 10/1987 | Buckley | |
| 4,710,981 | A | | 12/1987 | Sanchez | |
| 4,834,688 | A | | 5/1989 | Jones | |
| 4,875,237 | A | | 10/1989 | Cohen | |
| 4,899,395 | A | | 2/1990 | Spector | |
| 4,924,613 | A | | 5/1990 | Levin | |
| 4,969,214 | A | | 11/1990 | Cohen | |
| 5,005,219 | A | | 4/1991 | Diaz | |
| 5,031,763 | A | | 7/1991 | Lynam | |
| 5,042,091 | A | | 8/1991 | Tonkens | |
| 5,073,987 | A | | 12/1991 | Crosier | |
| 5,121,505 | A | | 6/1992 | Ludmer et al. | |
| 5,173,968 | A | | 12/1992 | Fox | |
| 5,299,324 | A | | 4/1994 | Zinna | |
| 5,398,345 | A | | 3/1995 | Kenneth et al. | |
| 5,465,426 | A | | 11/1995 | Beaton | |
| 5,468,152 | A | | 11/1995 | Lenart | |
| 5,561,865 | A | | 10/1996 | Fjelstul | |
| 5,581,815 | A | | 12/1996 | Hans | |
| 5,583,489 | A | | 12/1996 | Loemker et al. | |
| 5,632,044 | A | | 5/1997 | Sloot | |
| 5,642,526 | A | | 7/1997 | Thompson | |
| 5,669,078 | A | | 9/1997 | Scremin et al. | |
| 5,724,679 | A | | 3/1998 | Hans | |
| 5,737,775 | A | | 4/1998 | Schwartz | |
| 5,809,576 | A | * | 9/1998 | Huston et al. | 2/247 |
| 5,832,540 | A | | 11/1998 | Knight | |
| 5,870,777 | A | | 2/1999 | Hans | |
| 5,913,409 | A | | 6/1999 | Test | |
| 5,933,873 | A | | 8/1999 | Curran et al. | |
| 5,943,698 | A | | 8/1999 | Blanks | |
| 5,953,757 | A | | 9/1999 | Blanks | |
| 6,023,790 | A | | 2/2000 | Schwartz | |
| 6,119,614 | A | | 9/2000 | Kimura | |
| 6,131,205 | A | | 10/2000 | Arem | |
| 6,179,159 | B1 | | 1/2001 | Gurley | |
| 6,487,725 | B1 | | 12/2002 | Jordan | |
| D479,400 | S | | 9/2003 | Clymer | |
| 6,751,805 | B1 | | 6/2004 | Austion | |
| 6,763,632 | B1 | | 7/2004 | Exby | |
| 6,810,529 | B1 | | 11/2004 | Reilly et al. | |
| 6,845,518 | B1 | | 1/2005 | Boesen | |
| 7,168,098 | B2 | | 1/2007 | West | |
| 7,254,841 | B1 | | 8/2007 | Nelson et al. | |
| 7,296,303 | B1 | * | 11/2007 | Samet | 2/115 |
| 7,360,334 | B2 | | 4/2008 | Christiansen | |
| 7,444,772 | B2 | | 11/2008 | Harasawa et al. | |
| 7,454,856 | B2 | | 11/2008 | Passman | |
| 7,620,998 | B2 | | 11/2009 | Sandoval | |
| 6,487,725 | C1 | | 3/2011 | Jordan | |
| 7,992,225 | B2 | | 8/2011 | Demus | |
| 8,032,948 | B2 | | 10/2011 | Anderson | |
| 8,209,772 | B2 | | 7/2012 | Curry | |
| 8,316,469 | B2 | * | 11/2012 | Miller | 2/227 |
| 8,453,265 | B2 | | 6/2013 | Forte et al. | |
| 2001/0004577 | A1 | | 6/2001 | Lewis | |
| 2002/0144442 | A1 | | 10/2002 | Harasawa et al. | |
| 2003/0070206 | A1 | | 4/2003 | Palumbo | |
| 2003/0101502 | A1 | | 6/2003 | Hayes | |
| 2005/0114988 | A1 | | 6/2005 | Dow | |
| 2006/0026735 | A1 | | 2/2006 | Kensic | |
| 2006/0080752 | A1 | | 4/2006 | Darling et al. | |
| 2006/0206990 | A1 | | 9/2006 | Demus | |
| 2006/0211937 | A1 | | 9/2006 | Eldridge | |
| 2009/0158489 | A1 | | 6/2009 | White et al. | |
| 2009/0158490 | A1 | | 6/2009 | White et al. | |
| 2010/0035027 | A1 | | 2/2010 | Hill | |
| 2010/0095571 | A1 | | 4/2010 | James | |
| 2010/0306899 | A1 | | 12/2010 | Kolb | |
| 2010/0325769 | A1 | | 12/2010 | Tseng | |
| 2011/0047669 | A1 | | 3/2011 | Carr | |
| 2011/0067169 | A1 | | 3/2011 | Compton et al. | |
| 2011/0185477 | A1 | | 8/2011 | Olenicoff | |
| 2011/0277219 | A1 | | 11/2011 | Demus | |
| 2012/0060261 | A1 | | 3/2012 | Raviv | |
| 2012/0137399 | A1 | | 6/2012 | Forte et al. | |
| 2012/0151655 | A1 | | 6/2012 | Jarboe | |
| 2012/0186000 | A1 | | 7/2012 | Raviv | |
| 2012/0216326 | A1 | | 8/2012 | Van Kuren et al. | |
| 2013/0061367 | A1 | * | 3/2013 | Garneau | 2/85 |

* cited by examiner

RACE BIB PROTECTIVE POCKET

RELATED APPLICATION

The present application claims priority to U.S. Provisional Patent Application Ser. No. 61/803,935, filed Mar. 21, 2013, the disclosure of which is incorporated by reference herein in its entirety.

FIELD OF THE INVENTION

The present invention relates to semi-translucent protective pockets for use with apparel, and, more particularly, to lightweight, semi-translucent protective pockets for use with athletic apparel to hold substantially two-dimensional objects such as race bibs, race numbers or other athlete-identifying numbers or indicia.

BACKGROUND OF THE INVENTION

Participants in competitive athletic events such as marathons and various adventure and endurance obstacle course races, such as Tough Mudder®, are assigned individual numbers or other alpha-numeric identifiers that are printed on substantially two-dimensional rectangular pieces of material (e.g., paper, Tyvek, etc.). These objects are known as race bibs and have a minimal thickness (e.g., see race bib 30 in FIG. 5), so they are being described herein as "substantially two-dimensional" to denote same.

Race bibs are typically secured to race participants' apparel with one or more ordinary safety pins, which can inadvertently become opened during the race, resulting in the loss of the race bib (e.g., it is torn off) and/or the participant being stuck with the sharp point of the pin. The use of safety pins can also damage or ruin the sports apparel.

SUMMARY OF THE INVENTION

In one embodiment, the present invention provides a lightweight, semi-translucent protective pocket comprising a first fabric having a first surface and a second surface opposite the first surface; a second fabric having a perimeter including first, second, third and fourth sides, and having a plurality of spaced apertures; and a border member extending along the first, second and third sides of the perimeter. The border member is secured to one of the surfaces of the first fabric. The first and second fabrics cooperate to form the protective pocket therebetween. The protective pocket has an opening adjacent the fourth side of the perimeter.

The protective pocket is configured to removeably receive a substantially two-dimensional object and maintain the substantially two-dimensional object in a substantially vertical planar orientation, so that it is substantially parallel to the first and second surfaces of said first fabric. In one specific example, the substantially two-dimensional object is a race bib.

The plurality of spaced apertures allows the exposure of the substantially two-dimensional object to elements encountered during a race. The plurality of spaced apertures also facilitates visibility of the substantially two-dimensional object therethrough.

In one embodiment, the first fabric is an item of apparel, or a portion of such an item, and the second fabric is a mesh member. In another embodiment, the first fabric is a backing that is preferably made of a solid sheet of non-mesh material, and the second fabric is a mesh member, wherein the backing is attached to an item of apparel.

BRIEF DESCRIPTION OF THE DRAWINGS

For a more complete understanding of the present invention, reference is made to the following detailed description of exemplary embodiments considered in conjunction with the accompanying drawings, in which.

While the above-identified drawings set forth presently disclosed embodiments, other embodiments are also contemplated, as noted in the detailed description. This disclosure presents illustrative embodiments by way of representation and not limitation. Numerous other modifications and embodiments can be devised by those skilled in the art which fall within the scope and spirit of the principles of the presently disclosed invention.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Figure 1:
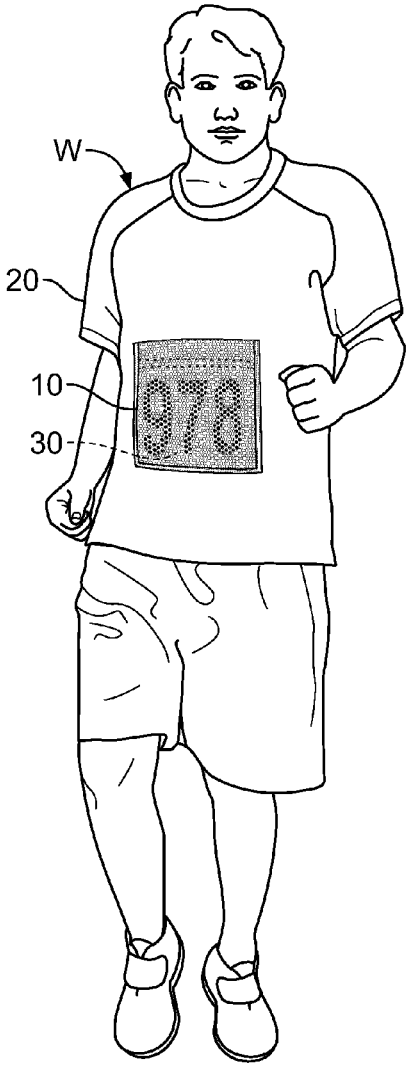
FIG. 1 is an environmental view of a protective pocket according to an embodiment of the present invention, as used with a shirt by a race participant.
Figure 2:
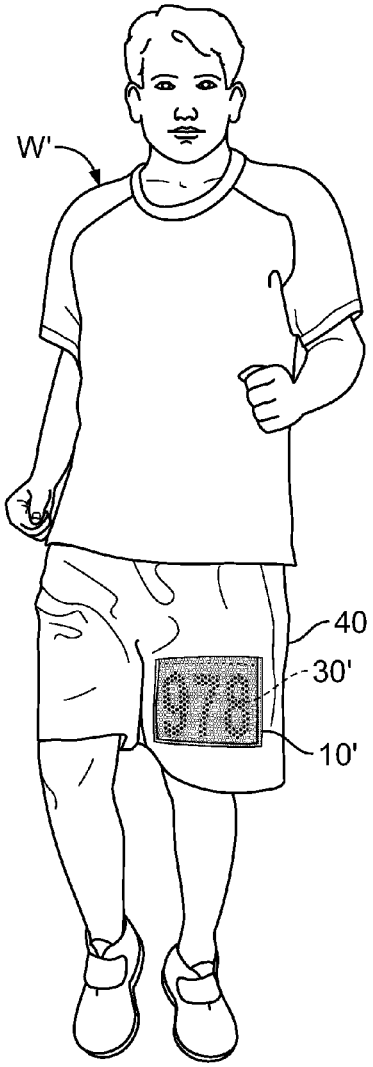
FIG. 2 is an environmental view of a protective pocket according to another embodiment of the present invention, as used with shorts by a race participant.

FIG. 1 illustrates a first race participant W with a protective pocket 10 constructed in accordance with an embodiment of the present invention. The protective pocket 10 is attached to a shirt 20, which has opposed first (i.e., outer) and second (i.e., inner) surfaces, and contains a race bib 30. FIG. 2 illustrates a second race participant W' with a protective pocket 10' attached to a pair of shorts 40, and containing a race bib 30'. The protective pockets 10 and 10' illustrated in FIGS. 1 and 2 are made of one or more lightweight materials. The protective pockets 10 and 10' are each configured to removeably receive a substantially two-dimensional object therein, such as the race bib 30, and secure the substantially two-dimensional object in place on the bodies of participants W and W'. The protective pockets 10 and 10' are each further configured to maintain the substantially two-dimensional object in a substantially vertical planar orientation, in which the substantially two-dimensional object is (a) substantially parallel to the plane defined by the adjacent surface of the shirt 20, shorts 40, or other apparel item, and (b) substantially parallel to the plane defined by the adjacent body part of the race participant W or W' (e.g., a torso or leg), as further explained below. It is understood that all of the structural and functional features described below in connection with the protective pocket 10 are also descriptive of the protective pocket 10', unless indicated otherwise.

Figure 3:
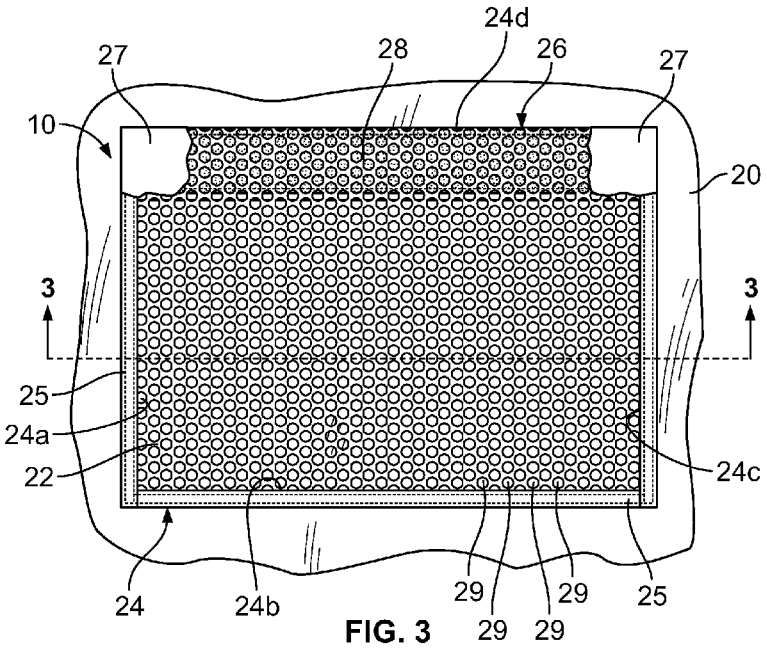
FIG. 3 is a front elevational view of one of the protective pockets of FIGS. 1 and 2, and includes partial cutaways showing the protective flap thereof.
Figure 4:
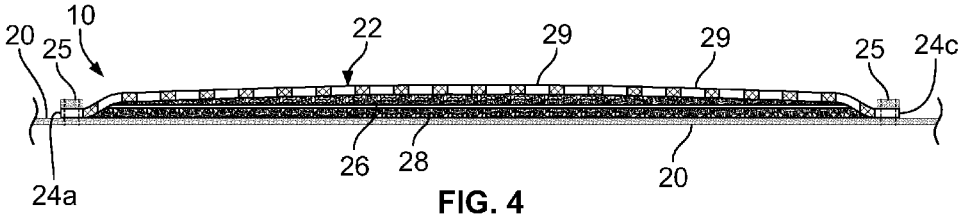
FIG. 4 is a cross-sectional view of the protective pocket of FIG. 3, as taken along lines 3-3.

With reference now to FIGS. 1, 3 and 4, the protective pocket 10 includes a substantially rectangular mesh member 22, through which the race number or other alpha-numeric identifier printed on the race bib 30 is visible (see FIG. 1). The mesh member 22 has a perimeter 24 including first, second, third and fourth sides 24*a*, 24*b*, 24*c* and 24*d*, respectively. The protective pocket 10 further includes a border member 25 that extends along the first, second and third sides 24*a*, 24*b* and 24*c* of the perimeter 24. The border member 25 is attached (e.g., using stitches, adhesive, or other known attachment means) to the shirt 20 (or another apparel item, such as shorts (see FIG. 2), a tank top, pants, a jacket, a sports bra, yoga pants, yoga shorts, boy shorts, a track and field jersey, a triathlon jersey and a cycling jersey), in order to secure the mesh member 22 thereto. The shirt 20 constitutes a first fabric, and the mesh member 22 constitutes a second fabric. Once secured to the shirt 20 via the border member 25, the mesh member 22 cooperates with the shirt 20 to form the protective pocket 10 therebetween.

Figure 5:
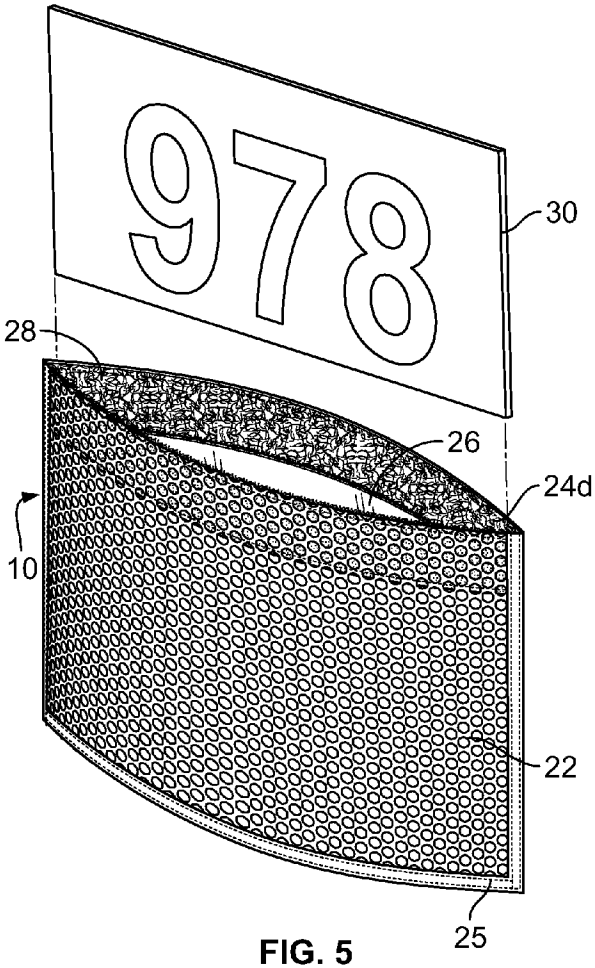
FIG. 5 is a top perspective view of the protective pocket of FIGS. 3 and 4, as being used with a race bib in accordance with an embodiment of the present invention.

As further illustrated in FIGS. 3, 4 and 5, the protective pocket 10 includes an opening 26 along the "top" of the mesh member 22, adjacent to and defined on one side by the fourth side 24*d* of the perimeter 24, and adjacent to and defined on the opposite side by the shirt 20. The opening 26 of the protective pocket 10 is dimensioned so as to receive the race bib 30 therethrough (see FIG. 5), as further discussed below. Once a participant in a competitive athletic event has received his or her race bib (i.e., prior to or at the event), he or she pulls the fourth side 24*d* of the perimeter 24 away from the shirt 20, so as to access the opening 26 of the protective pocket 10. The participant then inserts the race bib 30 through the opening 26, and moves the fourth side 24*d* of the perimeter 24 towards the shirt 20 until touching same in order to close the opening 26, whereupon the race bib 30 is secured within the protective pocket 10.

With continuing reference to FIG. 5, the protective pocket 10 and its opening 26 may be formed with dimensions that are slightly larger than a standard size race bib 30, so as to easily receive the race bib 30 therein. A standard size race bib may be, for example, 8" by 6" or a similar size. Protective pockets 10 may be made for different sizes of race bibs. In an alternate embodiment, the protective pocket 10 and its opening 26 are formed with dimensions that are large enough to receive any utilized size of race bib (or other substantially two-dimensional object) therein.

As indicated above, the protective pocket 10 is configured to maintain the race bib 30 (or other substantially two-dimensional object) in a substantially vertical planar orientation while it is contained in the protective pocket 10. The race bib 30 is thereby maintained in an "upright" position such that it is (a) substantially parallel to the plane defined by the adjacent surface of the shirt 20, or other apparel item, and (b) substantially parallel to the plane defined by the adjacent body part of the race participant W (e.g., a torso, as illustrated in FIG. 1). This positioning also improves the visibility of the race number or other alpha-numeric identifier printed on the race bib 30 through the mesh member 22. In order to facilitate this positioning of the race bib 30 within the protective pocket 10, the mesh member 22 is tightly secured to the shirt 20 (i.e., via the border member 26 along the first, second and third sides 24*a*, 24*b* and 24*c* of the perimeter 24) so as to allow limited movement between open and closed positions. In other words, the protective pocket 10 can only be opened wide enough to receive a substantially two-dimensional object, e.g., the race bib 30, as illustrated in FIG. 5.

In an embodiment, the protective pocket 10 includes closure means by which to maintain opening 26 in a closed position, in order to better secure the race bib 30 in the protective pocket 10. Such closure means may be hook and loop fasteners 28, as illustrated in FIGS. 3-5. Alternative closure means known in the art may also be used, including, but not limited to, a zipper, buttons and snaps. A separate piece of fabric may be provided as a covering (not shown) to protect the closure means. For example, a protective flap 27 may be secured to the protective pocket 10 over the closure means (see FIG. 3). If the protective flap 27 has a double panel construction with open ends, it may also function as an auxiliary compartment for receiving small objects (e.g., pens, lip balm, etc.).

Referring again to FIG. 1, the mesh member 22 is partially opaque, but includes a plurality of spaced apertures 29 through which the number (or other identifying indicia) on the race bib 30 is visible. The apertures 29 in the mesh member 22 facilitate the partial exposure of the race bib 30 such that it can be stained by elements encountered during the race, such as mud. The race participant may thereby keep the stained race bib 30 as a memento of the race.

The mesh member 22 may be made of different types of mesh material, so long as the mesh material is (a) flexible and elastic enough to expand when the protective pocket 10 is opened to insert the race bib 30 through the opening 26, and then return to its unexpanded state, but also (b) rigid enough to maintain the race bib 10 in the upright position, as discussed above. Such materials include polyester and nylon. The mesh member 22 may also have any one of several different mesh styles, aperture patterns, and/or aperture sizes of the suitable mesh materials known in the art. The mesh used in making the mesh member 22 is also lightweight.

Figure 6:
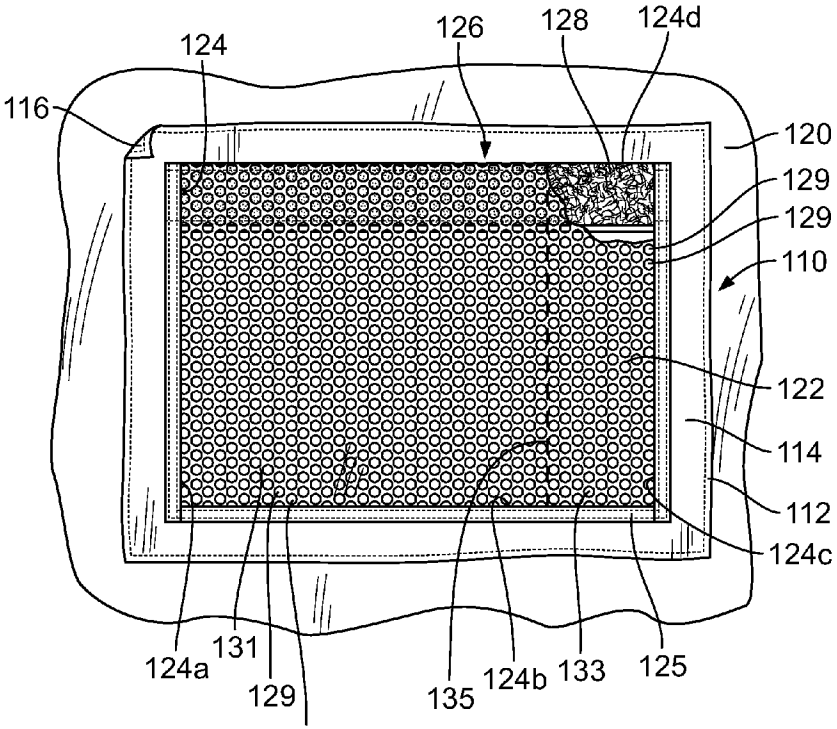
FIG. 6 is a front elevational view of the protective pocket according to another embodiment of the present invention, and includes a partial cutaway showing the hook and loop fasteners thereof.

Another embodiment of the protective pocket 110 is illustrated with an apparel item 120 (e.g., a shirt, shorts, etc.) in FIG. 6. The elements illustrated in FIG. 6, which correspond to the elements described above with reference to FIGS. 1-5, have been designated by corresponding reference numerals increased by one hundred, while new elements are designated by non-corresponding reference numerals.

With continuing reference to FIG. 6, the first fabric of the protective pocket 110 is a substantially rectangular backing 112 having opposed first (i.e., front) and second (i.e., rear) surfaces 114 and 116, respectively. The backing 112 is preferably made of a solid sheet of non-mesh material (e.g., cotton, polyester, rayon, etc.) The second fabric of the protective pocket is a substantially rectangular mesh member 122, which is similar to the mesh member 22 of the embodiment described above, and may have a smaller surface area than the rectangular backing 112. The mesh member 122 has a perimeter 124 including first, second, third and fourth sides 124*a*, 124*b*, 124*c* and 124*d*, respectively. The protective pocket 110 further includes a border member 125 that extends along the first, second and third sides 124*a*, 124*b* and 124*c* of the perimeter 124. The border member 125 is attached (e.g., using stitches, adhesive, or other known attachment means) to the front surface 114 of the rectangular backing 112, whereby the mesh member 122 cooperates with the front surface 114 to form the protective pocket 110 therebetween. The rear surface 116 of the rectangular backing 112 is attached (e.g., using stitches, adhesive, or other known attachment means) to the item of apparel 120 in order to ultimately secure the mesh member 122 thereto.

As further illustrated in FIG. 6, the protective pocket 110 includes an opening 126 along the "top" of the mesh member 122, adjacent to and defined on one side by the fourth side 124*d* of the perimeter 124, and adjacent to and defined on the opposite side by the front surface 114 of the rectangular backing 112. The opening 126 is dimensioned so as to receive a race bib (not shown) therethrough, similar to the opening 26 of the protective pocket 10 illustrated in FIG. 5 and discussed above. Once a participant in a competitive athletic event has received his or her race bib (i.e., prior to or at the event), he or she pulls the fourth side 124*d* of the perimeter 124 away from the item of apparel 20, so as to access the opening 126 of the protective pocket 110. The participant then inserts the race bib (not shown) through the opening 126, and moves the fourth side 124*d* of the perimeter 124 towards the apparel item 120 until touching same to close the opening 126, whereupon the race bib is secured within the protective pocket 110.

The protective pocket 110 is configured to maintain the race bib (or other substantially two-dimensional object) in a substantially vertical planar orientation while it is contained in the protective pocket 110. The race bib is thereby maintained in an "upright" position such that it is (a) substantially parallel to the plane defined by the adjacent surface of the apparel item 120, and (b) substantially parallel to the plane defined by the adjacent body part of the race participant (e.g., a torso or leg). This positioning also improves the visibility of the race number or other alpha-numeric identifier printed on the race bib through the mesh member 122. In order to facilitate this positioning of the race bib within the protective pocket 110, the mesh member 122 is tightly secured to front surface 114 of the rectangular backing 112 (i.e., via the border member 126 along the first, second and third sides 124*a*, 124*b* and 124*c* of the perimeter 124) so as to allow limited movement between open and closed positions. In other words, the protective pocket 110 can only be opened wide enough to receive a substantially two-dimensional object, e.g., the race bib.

In an embodiment, the protective pocket 110 includes closure means by which to maintain opening 126 in a closed position, in order to better secure the race bib in the protective pocket 110. Such closure means may be hook and loop fasteners 128, as illustrated in FIG. 5. Alternative closure means known in the art may also be used, including, but not limited to, a zipper, buttons and snaps. A separate fabric covering may be provided to protect the closure means, such as the protective flap 27 described above in connection with the protective pocket 10.

Like the mesh member 22 described above, the mesh member 122 is partially opaque, but includes a plurality of spaced apertures 129 through which the number (or other identifying indicia) on the race bib is visible. The apertures 129 in the mesh member 122 facilitate the partial exposure of the race bib such that it can be stained by elements encountered during the race, such as mud. The race participant may thereby keep the stained race bib as a memento of the race. The mesh member 122 may be made of any of the same mesh materials described above in connection with the mesh member 22.

Referring again to FIG. 6, the illustrated embodiment of protective pocket 110 includes first and second compartments 131 and 133, respectively, which are separated by stitching 135. The first compartment 131 is dimensioned to contain a race bib, as described above, while the second compartment 133 is configured to contain another object, such an illuminated glow stick (not shown). Both of the disclosed embodiments of the protective pocket 10 and 110 may have one or more compartments.

In another embodiment, the protective pocket 110 is secured to the apparel item 120 from the inside thereof. A substantially rectangular cut-out having a surface area equal to or approximately equal to that of the mesh member 122 is formed in the apparel item 120. The protective pocket 110 is then positioned against an inside surface of the apparel item 120 such that the mesh member 122 protrudes through the cut-out, but the entire rectangular backing 112 remains inside the apparel item 120. The rectangular backing 112 is then secured to the apparel item 120 such that only the mesh member 122 is visible from the outside of the apparel item 120.

In another embodiment, the protective pocket is configured to be removeably or permanently secured to an apparel item, or a racing belt. The protective pocket may be secured via hook and loop fasteners, a zipper, buttons, snaps, or any alternative closure means known in the art.

In another embodiment, the protective pocket includes two cords secured at opposite sides thereof (e.g., one cord at each of two opposed corners) and in between the first and second fabrics. The ends of the cords opposite those secured to the protective pocket include closure means, such as toggles or rope locks. The cords are inserted through the race bib and thereby used to secure the race bib in place (e.g., proximate an upper side of the protective pocket).

It should be noted that the present invention can have numerous modifications and variations. For example, the opening of the protective pocket may be formed on the "bottom" or on one of the left- or right-hand sides of the mesh member rather than the top (as disclosed above), it being understood that the designations first, second, third and fourth sides are arbitrary, and may each be used to describe any side of the mesh member.

Further, while a number of embodiments of the present invention have been described, it is understood that these embodiments are illustrative only, and not restrictive, and that many additional modifications and/or alternative embodiments may become apparent to those of ordinary skill in the art. Therefore, it will be understood that the appended claims are intended to cover all such modifications and embodiments that come within the spirit and scope of the present invention.

I claim:

1. In combination:

an apparel item, at least a portion of which includes an outer surface and an inner surface opposite said outer surface;

a race bib having numerals thereon identifying a race participant, a generally rectangular shape including a first length and a first width, and being substantially two-dimensional; and a protective pocket attached to said apparel item, said protective pocket having a generally rectangular shape complementary to said generally rectangular shape of said race bib and having a second length and second width complementary to said first length and said first width, respectively, of said race bib, said protective pocket including a mesh member having a perimeter including a first side, a second side, a third side opposite said first side, and a fourth side opposite said second side and adjacent an upper end of said mesh member, said mesh member cooperating with a portion of said outer surface of said apparel item to form said protective pocket therebetween, said protective pocket containing said race bib, said race bib obscuring said portion of said outer surface of said apparel item from view, said protective pocket having an opening adjacent said fourth side of said perimeter for permitting the insertion and removal of said race bib into and from said protective pocket, said mesh member further including a plurality of spaced apertures sized, shaped and arranged so as to facilitate visibility of said race bib and said numerals therethrough and to allow exposure of said race bib to elements encountered during a race;

a border member extending along said first, second and third sides of said perimeter, said border member being secured to said outer surface of said apparel item; and closure means located adjacent said fourth side of said perimeter for selectively opening said opening of said protective pocket to allow insertion of said race bib into said protective pocket and for selectively closing said opening of said protective pocket to inhibit removal of said race bib from said protective pocket.

2. The combination of claim 1, wherein said apparel item is selected from the group consisting of a shirt, a tank top, shorts, pants, a jacket, a sports bra, yoga pants, yoga shorts, boy shorts, a track and field jersey, a triathlon jersey and a cycling jersey.

3. The combination of claim 1, wherein said protective pocket further includes a protective flap overlying said closure means.

4. The combination of claim 3, wherein said protective flap has a double panel construction including a first panel, a second panel overlapping said first panel, a first closed side substantially parallel to said second side of said perimeter of said mesh member, a second closed side opposite said first closed side, a first open end adjacent said first side of said perimeter of said mesh member, and a second open end adjacent said third side of said perimeter of said mesh member.

5. The combination of claim 4, wherein said protective flap includes an auxiliary compartment between said first open end and said second open end, said auxiliary compartment being sized and shaped so as to receive a small object.

6. The combination of claim 5, wherein said auxiliary compartment is configured to receive an elongated object selected from the group consisting of lip balm, a pen, a pencil, a glow stick, and a rolled-up bill of paper currency.

7. The combination of claim 5, wherein said closure means is a zipper.

8. The combination of claim 5, wherein said closure means is a hook and loop fastening system.

9. The combination of claim 7, wherein said protective pocket is configured to receive a substantially two-dimensional object that is about 8 inches by about 6 inches.

10. The combination of claim 1, further comprising:

elements encountered during a race disposed on one or more portions of said race bib that are exposed by said plurality of shaped apertures of said mesh member.

11. The combination of claim 10, wherein said elements encountered during a race include mud.

12. The combination of claim 1, wherein each of said first side and said third side of said mesh member has a first length and each of said second side and said fourth side of said mesh member has a second length that is greater than said first length.

13. The combination of claim 1, wherein said protective pocket maintains said race bib in a substantially vertical planar orientation, so as to be substantially parallel to said outer and inner surfaces of said apparel item.

* * * * *